United States Patent [19]

Funke

[11] 4,191,315

[45] Mar. 4, 1980

[54] CLOSURE

[76] Inventor: Ludwig F. Funke, 7200 Newburgh Rd., Evansville, Ind. 47715

[21] Appl. No.: 945,108

[22] Filed: Sep. 25, 1978

Related U.S. Application Data

[63] Continuation of Ser. No. 774,132, Mar. 3, 1977, abandoned.

[51] Int. Cl.[2] ..... B67D 3/00

[52] U.S. Cl. ..... 222/553

[58] Field of Search ..... 222/553, 549, 552, 519

[56] References Cited

U.S. PATENT DOCUMENTS

| | | | |
|---|---|---|---|
| 1,913,274 | 6/1933 | Hayden | 222/519 X |
| 3,121,519 | 2/1964 | Cherba | 222/549 X |
| 3,258,176 | 6/1966 | Cherba | 222/549 |

*Primary Examiner*—Joseph F. Peters, Jr.
*Assistant Examiner*—Norman L. Stack, Jr.
*Attorney, Agent, or Firm*—Warren D. Flackbert

[57] ABSTRACT

A dripless closure for a product container characterized by a cap movable on a body member, where the cap has a passageway or opening along the periphery of the upper surface thereof which selectively communicates with the contents of the container. The upper surface of the closure remains free of the product, and, further, the closure eliminates the necessity of the center post commonly found on containers presently in use.

3 Claims, 8 Drawing Figures

CLOSURE

This is a continuation of application Ser. No. 774,132, filed March 3, 1977, now abandoned. As is known, it is desirable to provide a closure for a product container which is inherently dripless. The so-called dripless bottles presently on the market seldom afford such a feature on a permanent basis, as, for example, when containing substances having high adhesion or stickiness, such as syrup, honey, soap detergents, and the like.

Basically, the prior closures are not dripless because the opening for pouring is in the center of the cap, and the contents must flow over the top surface to get to the outer edge of the cap when pouring. Therefore, some of the material that flows across the top of the cap remains and/or accumulates on the top surface when the bottle is upright, eventually dripping over the outer edge of the cap, as, for example, in the instance of a liquid which does not quickly evaporate.

Moreover, a typical requirement of the presently available dripless type closures is the use of a center post which cooperates with the opening in the upper surface of the cap to achieve a pouring or a non-pouring condition. The geometry of the post is such that the closure opening is necessarily much larger than should really be necessary.

In any event, the invention provides a dripless closure wherein the opening which communicates with the contents of the product container is disposed along the periphery of the upper surface of the cap. The cap is movable upwardly and downwardly on the body member defining part of the closure to effect pouring or non-pouring.

No center post is required, meaning a smaller size product opening and, further, simplified and/or reduced mold cost. The invention is adaptable to either a lift type or a threaded type closure, and the upper surface thereof is free from any accumulation of material being poured. Actually the difference of pressures forces or pushes the last drop of poured material back into the container, thereby avoiding spillage.

A better understanding of the present invention will become more apparent from the following description, taken in conjunction with the accompanying drawing, wherein FIG. 1 is a view in vertical section showing one form of dripless closure in accordance with the teachings of the present invention, in this instance in a pouring position;

Figure 1:
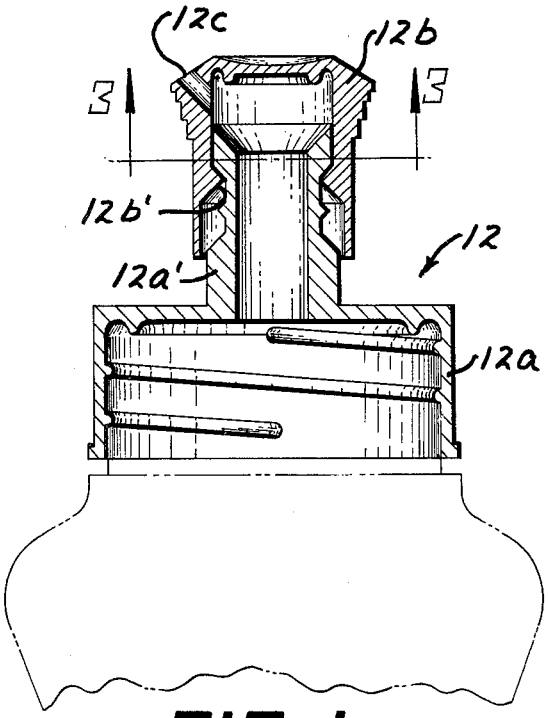

For the purposes of promoting an understanding of the principles of the invention, reference will now be made to the embodiments illustrated in the drawing and specific language will be used to describe the same. It will nevertheless be understood that no limitation of the scope of the invention is thereby intended, such alterations and further modifications of the illustrated devices and such further applications of the principles of the invention as illustrated therein being contemplated as would normally occur to one skilled in the art to which the invention relates.

Referring now to FIGS. 1, 2, 3 and 7, the dripless closure 12 of the invention is shown in combination with a product receiving container (in phantom lines). The closure 12 is defined by a body member **12*a* and a cap 12*b* movable on neck 12*a*' on the body member 12*a*. The cap 12*b* has an upper surface of any desired configuration, and includes an opening or passageway 12*c* along the periphery thereof which selectively communicates with the inside of the body member 12*a*** and, hence, the contents within the product container.

Figure 2:
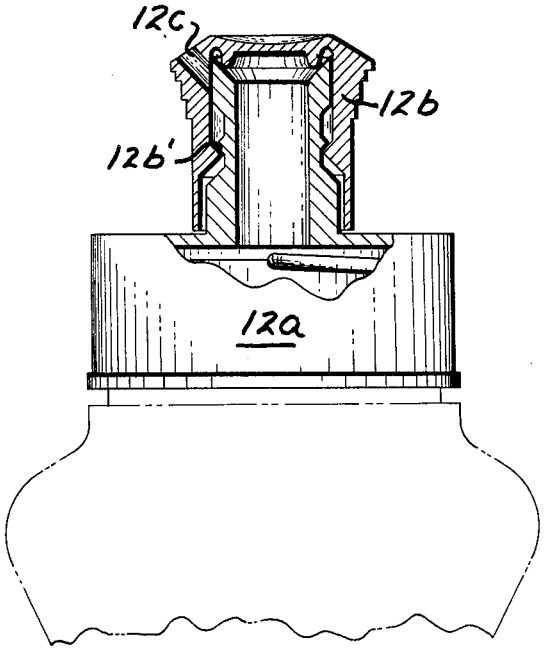
FIG. 2 is another view in vertical section showing the dripless closure of FIG. 1, but at a non-pouring position.
Figure 3:
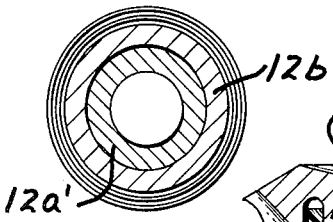
FIG. 3 is a view in horizontal section taken at line 3—3 on FIG. 1 and looking in the direction of the arrows.
Figure 2A:
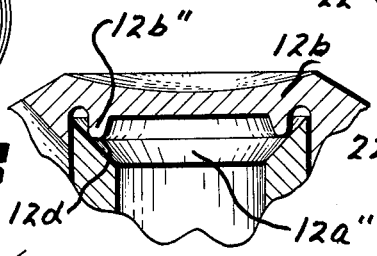
FIG. 2A is an enlarged fragmentary view in vertical section showing further details of the dripless closure at the non-pouring position of FIG. 2.

In use, and noting particularly FIGS. 1, 2 and 2A, FIG. 1 illustrates the cap **12*b* in a position for pouring, i.e. with the opening or passageway 12*c* communicating with the body member 12*a*. It should be noted that an annular inwardly directed projection 12*b*' is provided within the cap 12*b*, such serving to prevent the withdrawal of the cap 12*b* from the neck 12*a*' of the body member 12*a*** at an open or pouring position.

When the cap **12*b* is at the position of FIG. 2, the projection 12*b*' further serves to retain the cap 12*b* at a closed or non-pouring position. A seal, at 12*d*, between a projection 12*b*'' on the undersurface of the top of the cap 12*b* and innersurface 12*a*'' at the upper edge of the neck 12*a*' also precludes any leakage at such closed position, as during transport or shipment (see FIG. 2A**).

It should be understood that the position of the opening or passageway **12*c* along the periphery of the upper surface of the cap 12*b*** precludes passage or accumulation of the contents of the product container of each surface and, additionally, a difference of air pressure effectively pushes or returns the last drop of poured material into the container.

Figure 4:
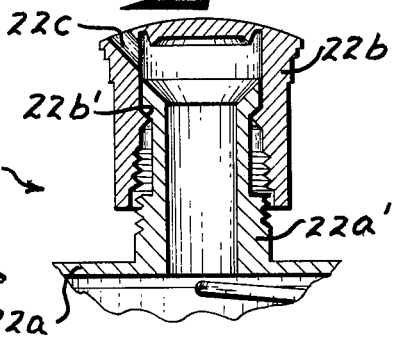
FIG. 4 is a view in vertical section of another form of dripless closure in accordance with the teachings of the invention, in this instance in a pouring position.
Figure 5:
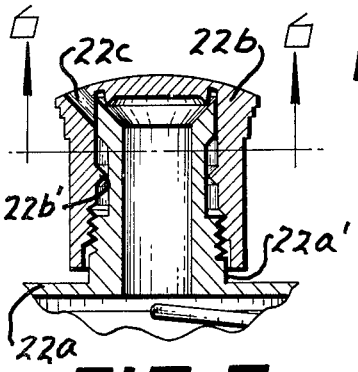
FIG. 5 is a view in vertical section of the dripless closure of FIG. 4, but at a non-pouring position.
Figure 6:
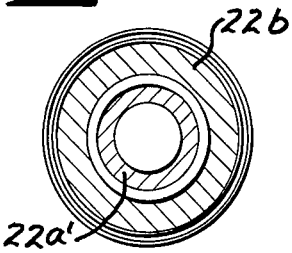
FIG. 6 is a view in horizontal section, taken at line 6—6 on FIG. 5 and looking in the direction of the arrows; and, FIG. 7 is a top plan view of the invention embodiment of FIG. 1.
Figure 7:
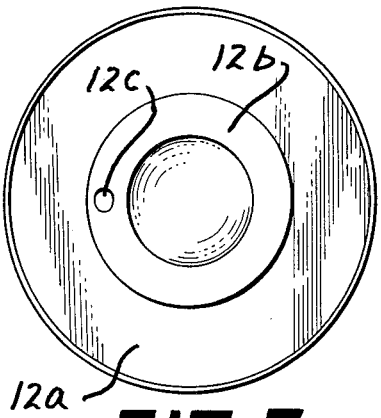

FIGS. 4, 5 and 6 illustrate another form of closure 22, but in this instance cap **22*b* is threadedly secured to the neck 22*a*' of the body member 22*a* when in a non-pouring or storage position (see FIG. 5). The invention embodiment of FIGS. 4, 5 and 6 basically compares to that of FIGS. 1, 2 and 3, including the cap 22*b* with the opening or passageway 22*c*, and annular projection 22*b*' for limiting movement of the cap 22*b* at the open or pouring position. The end purpose of closures 12 and 22** is the same, i.e. to achieve a dripless pouring function.

It should be apparent from the preceding that no center post assembly is reauired, minimizing the size of the opening or passageway **12*c*–22*c***. Moreover, and as stated, with the opening or passageway along the periphery of the upper surface of the cap, the contents of the product container have no reason to pass over and/or accumulate on such upper surface. The closure is adaptable for use with both plastic or glass bottles or containers, being positioned through threaded action. In a typical invention form, the closure is made from a plastic resin.

The closure described above is susceptible to various changes within the spirit of the invention. In this connection, proportioning may be varied, both inner and outer configurations altered, and the like. Thus, the preceding should be considered illustrative and not as limiting the scope of the following claims.

I claim:

1. A closure for a product container comprising a body member receiving a cap on a dispensing passageway, where said cap slides linearly on said body member to and from a pouring position and a non-pouring position and is freely rotatable thereon at said pouring position to automatically achieve pouring in any direction without the necessity of alignment, said cap having an upper surface blending into an outwardly flaring rim lower than said upper surface and including a downwardly depending side wall, and an outlet in said cap positioned in said outwardly flaring rim thereof proximate the juncture with said downwardly depending side wall selectively communicating with the contents of said product container and serving a dripless function when said product container is returned to a normal non-pouring position.

2. The closure of claim 1 where means on said cap cooperate with a portion of said body member to prevent movement of said cap beyond said pouring position.

3. The closure of claim 1 where means on the undersurface of the top of said cap cooperate with a portion of said body member at said non-pouring position in a sealing relationship.

* * * * *